US008671720B2

(12) United States Patent
Kim

(10) Patent No.: US 8,671,720 B2
(45) Date of Patent: Mar. 18, 2014

(54) DRUM WASHING MACHINE

(75) Inventor: Hyo Je Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 492 days.

(21) Appl. No.: 12/285,573

(22) Filed: Oct. 8, 2008

(65) Prior Publication Data

US 2009/0106911 A1 Apr. 30, 2009

(30) Foreign Application Priority Data

Oct. 9, 2007 (KR) ..... 10-2007-0101602

(51) Int. Cl.
*D06F 39/08* (2006.01)

(52) U.S. Cl.
USPC ..... 68/36; 68/5 R; 68/6; 68/152

(58) Field of Classification Search
None
See application file for complete search history.

(56) References Cited

U.S. PATENT DOCUMENTS 4,467,627 A 8/1984 Platt et al.
2003/0089139 A1* 5/2003 Orszulik ..... 68/58
2004/0244432 A1 12/2004 Kim et al.
2004/0255391 A1* 12/2004 Kim et al. ..... 8/149.3
2007/0169521 A1* 7/2007 Kim et al. ..... 68/5 R

FOREIGN PATENT DOCUMENTS

DE 102004043671 * 3/2006
KR 10-2007-0026923 A 3/2007
WO WO2006/027149 * 3/2006

OTHER PUBLICATIONS

Computer translation of DE102004043671 by Bloomberg et al., published Mar. 30, 2006.*

* cited by examiner

*Primary Examiner* — Michael Kornakov
*Assistant Examiner* — Ryan Coleman
(74) *Attorney, Agent, or Firm* — McKenna Long & Aldridge LLP

(57) ABSTRACT

A drum washing machine is provided to automatically wash out dirt on the door of the washing machine upon an operation of the washing machine. The drum washing machine comprises a cabinet having a door unit; a tub disposed inside the cabinet, the tub being configured to store water; a drum rotatably disposed inside the tub; and a circulator for simultaneously or selectively spraying wash water into the drum and toward the door unit.

7 Claims, 6 Drawing Sheets

DRUM WASHING MACHINE

This application claims the benefit of Korean Patent Application No. 10-2007-0101602 filed Oct. 9, 2007, which is hereby incorporated by reference for all purposes as if fully set forth herein.

BACKGROUND OF THE INVENTION

1. Field of the Invention

The present invention relates to a drum washing machine which can automatically wash a door unit.

2. Discussion of the Related Art

In general, a washing machine refers to an appliance for removing contaminants stuck to clothes, beddings and the like (hereinafter, referred to as "laundry") by using a chemical decomposition of water and detergent and a physical action, such as friction between water and laundry and a refresher for washing laundry easily by jetting steam to the laundry.

Such washing machines are divided into a water-jet washing machine for doing laundry by friction between laundry by forming turbulence in wash water in a washing tub that is raised and a drum type washing machine for washing laundry by a physical impact generated by the rotation of the drum when the laundry put into a drum is lifted by a lifter formed in the drum and then dropped.

Among these washing machines, the demand for the drum washing machine is greatly increasing in recent years because the drum washing machine causes less damage to fabrics compared to the water-jet washing machine. The drum washing machine generally has a door unit formed at the front surface, and hence it is often the case that contaminants or fuzz on laundry are stuck to the door unit and are not well removed. By the way, the door is made of a transparent material and designed to allow a user to look into a washing tub. Thus, if the door is stained with contaminants, the user will think that the washing machine is dirty. Of course, this problem can be solved by washing the door unit directly by the user themselves, but the washing is not always easy and it takes much effort to perform the washing.

SUMMARY OF THE INVENTION

An object of the present invention is to provide a means which is capable of effectively washing a stained door.

To achieve the above object, there is provided a drum washing machine according to the present invention, comprising: a cabinet having a door unit; a tub disposed inside the cabinet, the tub being configured to store water; a drum rotatably disposed inside the tub; and a circulator for simultaneously or selectively spraying wash water into the drum and toward the door unit.

The circulator may comprise a door unit circulator nozzle facing the door unit and a drum circulator nozzle facing into the drum. The circulator may further comprise a circulator nozzle valve for selecting at least one of the door unit circulator nozzle and the drum circulator nozzle. Preferably, the cross section area of the door unit circulator nozzle is smaller than the cross section area of the drum circulator nozzle.

The drum washing machine may further comprise a steam generator for simultaneously or selectively spraying heated steam into the drum or toward the door unit. The steam generator may further comprise a door unit steam nozzle facing the door unit and a drum steam nozzle facing into the drum. Additionally, the steam generator may further comprise a steam nozzle valve for selecting at least one of the door unit steam nozzle and the drum steam nozzle. Preferably, the cross section area of the door unit steam nozzle is smaller than the cross section area of the drum steam nozzle.

Furthermore, there is provided a washing method for a drum washing machine, the washing machine comprising: a cabinet having a door unit; a tub disposed inside the cabinet, the tub being configured to store water; a drum rotatably disposed inside the tub; and a circulator for simultaneously or selectively spraying wash water into the drum and toward the door unit, comprising: a water supply step of supplying wash water into the tub; and a door unit circulation water spraying step of at least allowing the circulator to spray wash water to the door unit to wash the door unit after the water supply step.

The drum washing machine may further comprises a tub heat supplier for heating the tub, and a tub heating step for heating the tub by the tub heat supplier may be carried out between the water supply step and the door unit circulation water spraying step. Additionally, the drum washing machine may further comprise a steam generator for simultaneously or selectively spraying heated steam into the drum and toward the door unit, and a door unit steam spraying step for spraying heated steam to the door unit may be carried out between the water supply step and the tub heating step.

The door is automatically washed while the drum washing machine carries out a washing stroke or the like.

BRIEF DESCRIPTION OF THE DRAWINGS

The accompanying drawings, which are included to provide a further understanding of the invention and are incorporated in and constitute a part of this specification, illustrate embodiments of the invention together with the description serve to explain the principles of the invention.

In the drawings.

DETAILED DESCRIPTION OF THE PREFERRED EMBODIMENTS

Figure 1:
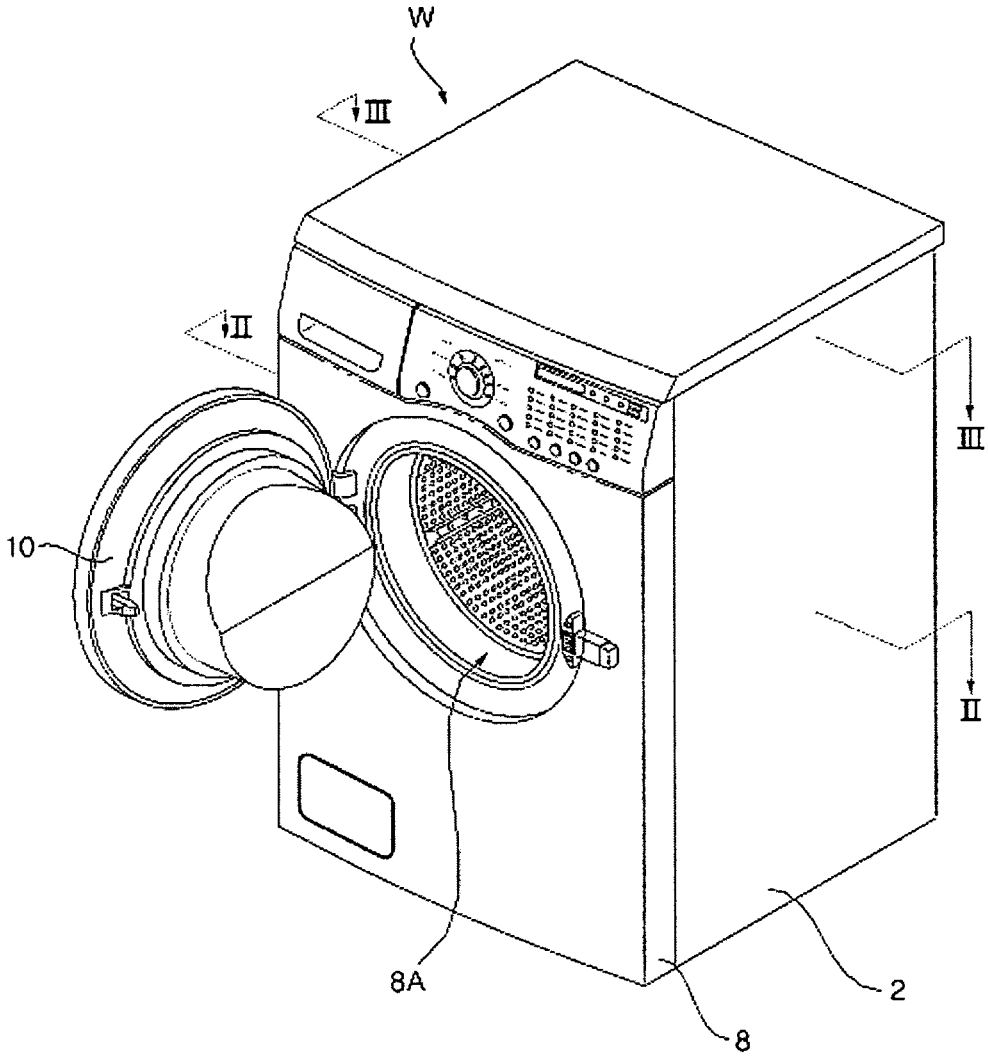
FIG. 1 illustrates a drum washing machine in accordance with an embodiment of the invention.
Figure 2:
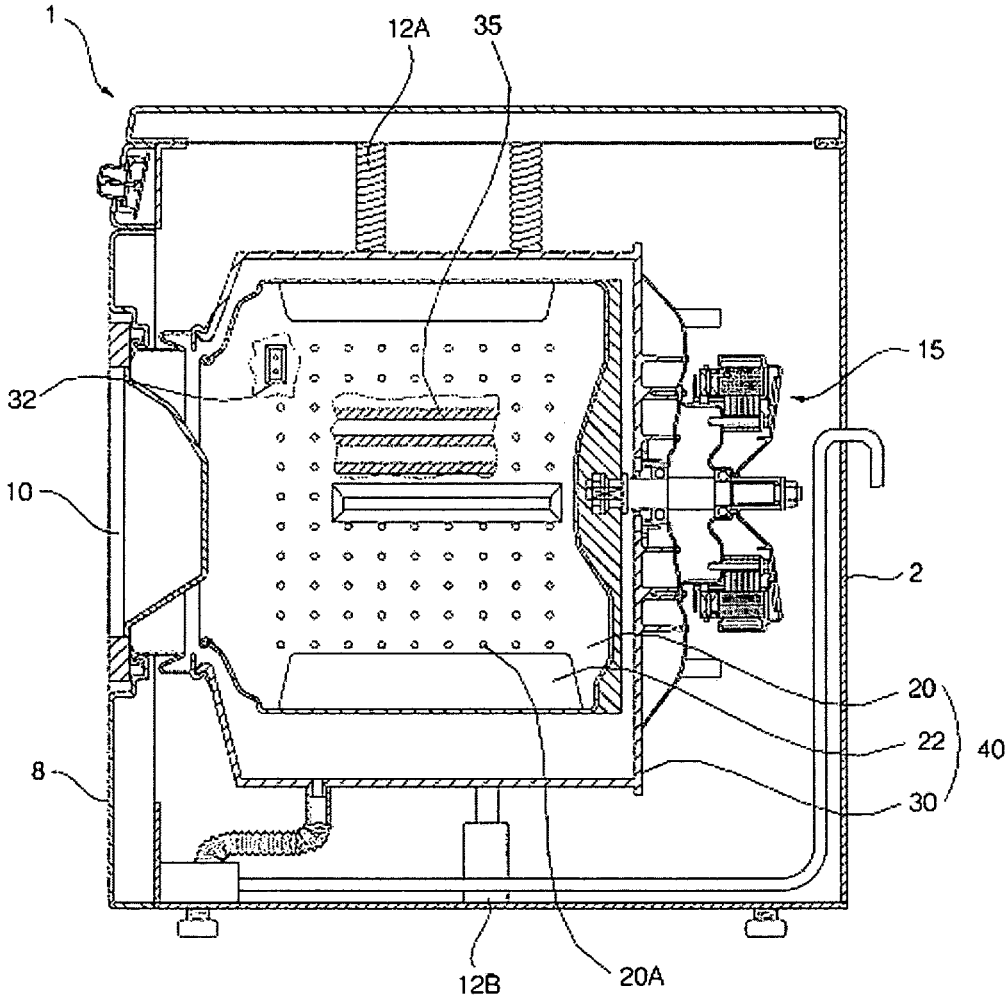
FIG. 2 illustrates a cross-sectional side-view of the drum washing machine of an embodiment of the present invention.
Figure 3:
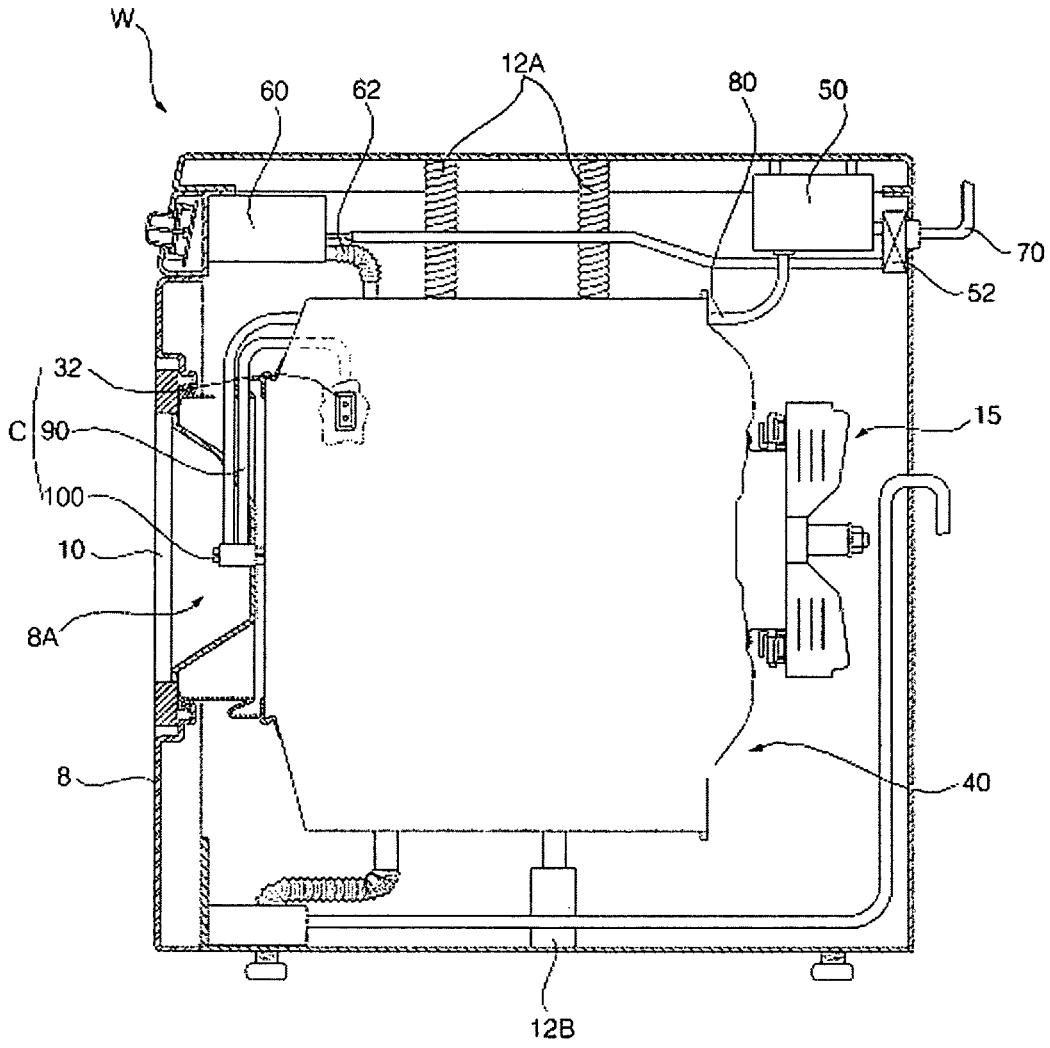
FIG. 3 illustrates another cross-sectional side-view of the drum washing machine an embodiment of the present invention.

Hereinafter, a drum washing machine in accordance with a first embodiment of the present invention will be described with reference to FIGS. 1 to 3.

A drum washing machine W includes a cabinet 2 forming the outer appearance of the washing machine 1, a washing tub 40 installed in the cabinet 2 and performing washing of laundry, a driving source 15 mounted at the rear of the washing tub 40 and providing a driving force to be transmitted to the washing tub 40, a cabinet cover 8 mounted on the front surface of the cabinet 2 and having a door unit 8A formed at the center and constituting one component of the cabinet, a door 10 rotatably installed on the cabinet cover 8 so as to open and close the door unit 8A of the cabinet cover 8, a detergent supplier 60 for mixing detergent with water supplied from the outside as the water passes therethrough; a water supply hose 62 for supplying wash water into a tub 30 to be described later from the water supplier 60, a steam generator 50 for generating steam by heating the water supplied from the outside, a steam hose 80 forming the passage of the steam so as to supply the steam generated by the steam generator 50 into the drum 20 through circulator nozzles to be described later, and nozzles 100 for simultaneously or selectively spraying the steam induced from the steam hose 80 into the drum 20 and toward the door unit 8A, and constituting one of the components of the circulator.

The washing tub 40 may include a tub 30 installed in the cabinet 2 so as to be damped by springs 12A and a damper 12B and containing wash water, a tube heat supplier 35 disposed in the tub 30 and for heating the wash water stored in the tub, a suction unit 32 disposed in the tub 30, sucking the wash water so as to spray the wash water stored in the tub 30 through the nozzles 100, and constituting one component of the circulator to be described later, a drum 20 rotatably installed in the tub 30 by the driving source 5 to hold laundry and having a plurality of through holes 20A through which wash water passes, and a lifter 22 installed on an inner surface of the drum 20 so that laundry can be lifted to a predetermined height and then dropped by gravity during the rotation of the drum 20.

Also, the drum washing machine W includes a circulator C for sucking the wash water stored in the tub 30 and simultaneously or selectively spraying the wash water into the drum 20 and toward the door unit 8A. The circulator C includes a suction unit 32 for sucking the wash water stored in the tub 30 by generating a pressure difference, a circulator hose 90 for inducing the wash water sucked through the suction unit 32, and nozzles 100 for simultaneously or selectively spraying the wash water induced through the circulator hose 90 into the drum 20 and toward the door unit 8A. The nozzles 100 are not always located on an upper surface in the door unit 8A as shown in FIG. 1, so their location is not specifically restricted.

Figure 4:
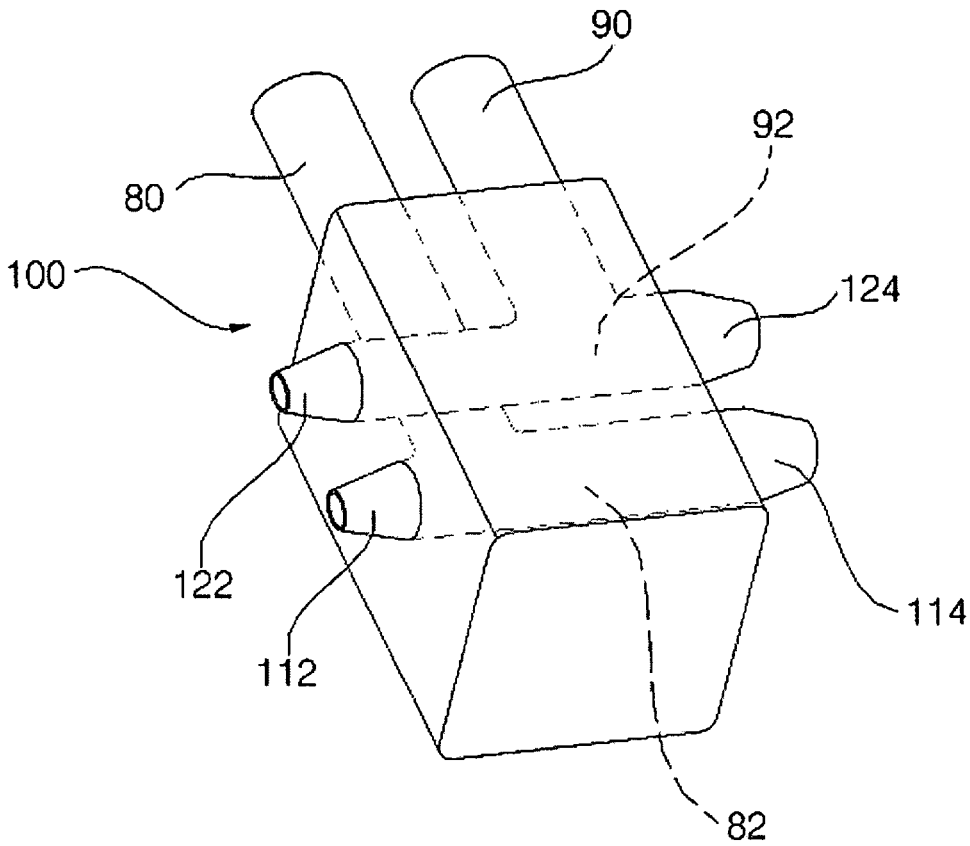
FIG. 4 illustrates nozzles provided in the drum washing machine in accordance with a first embodiment.

Hereinafter, the nozzles 100 provided at the drum washing machine W in accordance with the first embodiment of the present invention will be described with reference to FIG. 4.

The nozzles 100 can be divided into circulator nozzles and steam nozzles. The circulator nozzles include a door unit circulator nozzle 122 facing the door unit 8A and spraying the wash water sucked from the suction unit 32 toward the door 10 and a drum circulator nozzle 124 facing into the drum 20 and spraying the wash water sucked from the suction unit 32 into the drum 20. The steam nozzles include a door unit steam nozzle 112 facing the door unit and spraying the steam generated by the steam generator 50 toward the door 10 and a drum steam nozzle 114 facing the drum 20 and spraying the steam generated by the steam generator 50 toward the drum 20.

The door unit circulator nozzle 122 and the drum circulator nozzle 124 are connected to the circulator hose 90, and the passage of the circulator hose 90 may be formed in a T-shape such that the wash water may be induced toward the door unit circulator nozzle and the drum circulator nozzle. However, the passage is not always limited to the T-shape.

Preferably, the cross section area of the door unit circulator nozzle 122 is smaller than that of the drum circulator nozzle. The wash water sprayed from the drum circulator nozzle 124 is aimed to improve washing performance by getting laundry quickly wet with wash water, and hence the amount of the wash water sprayed from the drum circulator nozzle 124 is preferably large. On the other hand, the velocity of the wash water sprayed from the drum circulator nozzle 124 is preferably high because it is preferable that the pressure of the wash water when hitting laundry is high enough to remove dirt stuck to the drum. Therefore, the cross section area of each nozzle is designed as above, thus ensuring effective washing of the door 10 and maintaining the function of getting laundry quickly wet, which is the original purpose of the circulator.

The passages of the door unit steam nozzle 112 and drum steam nozzle 114 also may be formed in a T-shape such that introduced wash water may be induced toward each nozzle. Preferably, the cross section area of the door unit steam nozzle 112 is smaller than that of the drum steam nozzle 114.

By designing the nozzles 100 as described above, when the circulator C is operated to spray wash water into the drum 20, the wash water is sprayed to the door 10 as well to wash the door. Thus, the door does not need to be washed separately, thereby keeping the door clean.

Besides, when the wash water is heated by the tub heat supplier 35 and the heated wash water is sprayed to the door 10 through the door unit circulator nozzle 122, dirt stuck on the door is easily swollen, and accordingly the dirt is easily removed only by the pressure of the wash water being sprayed.

In a case where the drum washing machine carries out a stroke for spraying steam into the drum 20, heated steam is sprayed toward the door 10 as well, thereby easily removing dirt or the like stuck on the door 10.

Figure 5:
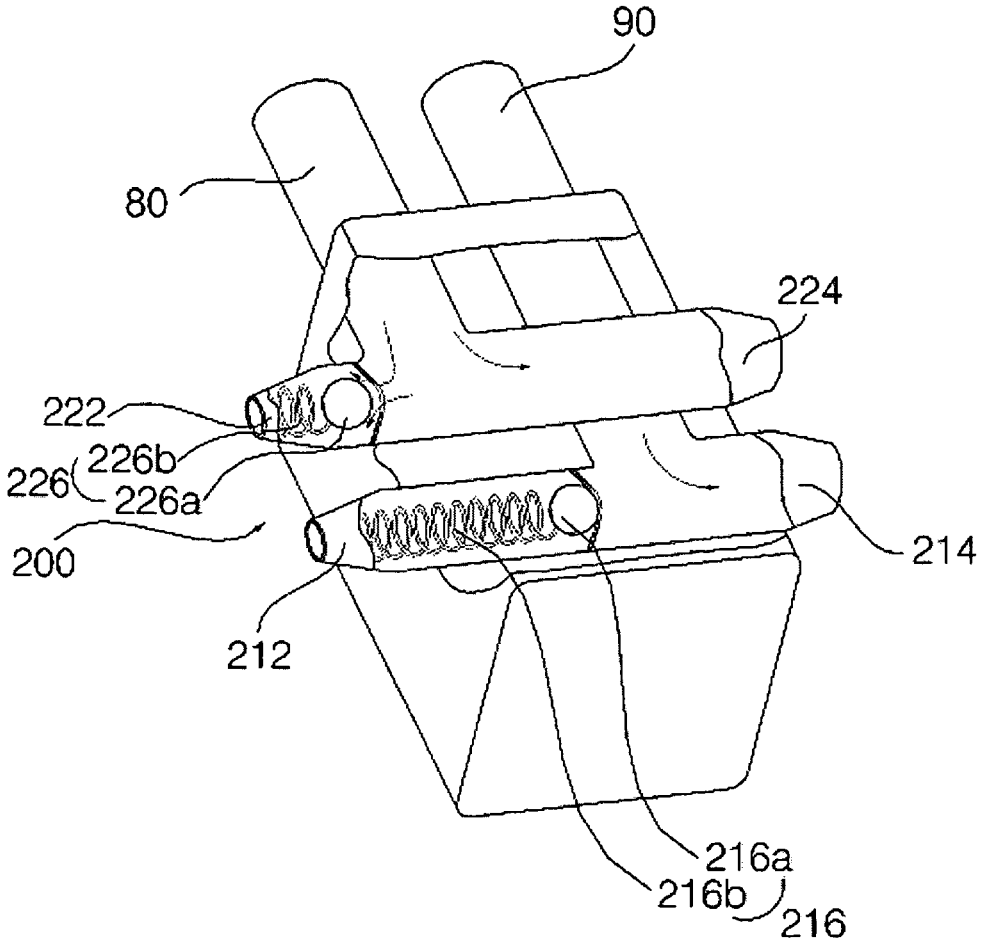
FIG. 5 illustrates nozzles provide in the drum washing machine in accordance with a second embodiment.
Figure 6:
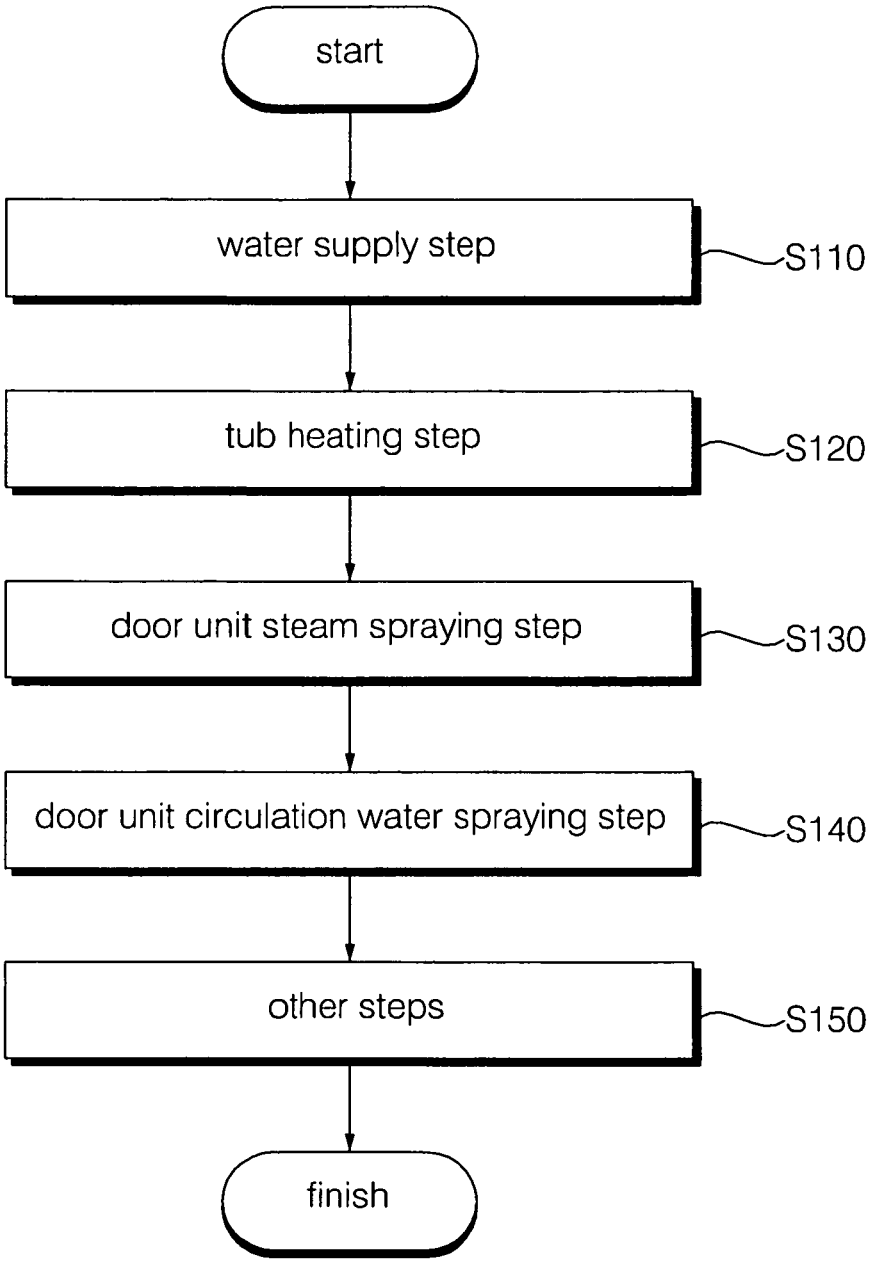
FIG. 6 illustrates an exemplary flow chart of the washing method of the drum washing machine.

Hereinafter, a drum washing machine in accordance with a second embodiment of the present invention will be described with reference to FIG. 5.

The components and operation of the drum washing machine according to this embodiment may be identical to those of the drum washing machine W in accordance with the first embodiment of the present invention except that nozzles are provided with a circulator nozzle valve 226 and a steam nozzle valve 216. Thus, descriptions overlapping with the first embodiment of the present invention will be omitted.

The nozzles 200 are provided with a circulator nozzle valve 226 which can select any one of a door unit circulator nozzle 222 and a drum circulator nozzle 224. As described above, when wash water is introduced via the circulator hose 90, the same pressure is formed in the door unit circulator nozzle 222 and the drum circulator nozzle 224, respectively to thus spray the wash water into each nozzle. However, the wash water flowing toward the door unit circulator nozzle 222 is blocked by the circulator nozzle valve 226. Therefore, when the circulator nozzle valve 226 is closed, the wash water is sprayed only via the drum circulator nozzle 224. In contrast, when the circulator nozzle valve 226 is opened, the door unit circulator nozzle 222 is opened, and accordingly the wash water is sprayed from the door unit circulator nozzle 222 and the drum circulator nozzle 224, respectively. The velocity of the wash water sprayed from the door unit circulator nozzle 222 and drum circulator nozzle 224 can be controlled. The velocity of the wash water sprayed from the door unit circulator nozzle 222 may be higher than the velocity of the wash water sprayed from the drum circulator nozzle 224. The velocity of wash water is not limited thereto but may be controlled variously. That is, the velocity of the wash water may be varied by arranging a pressure source for applying pressure to the door unit circulator nozzle 222 and a pressure source for applying pressure to the drum circulator nozzle 224.

The control of the circulator nozzle valve 226 may be implemented by various well-known means, such as a control motor, and an example thereof is as follows. The circulator nozzle valve 226 may consist of a spring 226*b* and a ball 226*a* supported by the spring. When wash water is sucked at a pressure of a predetermined level or higher and introduced into the nozzles 200, and a pressure enough to overcome the elasticity of the spring 226*b* is formed, the ball 226*a* is shifted to open the circulator nozzle valve 226. Then, the door unit circulator nozzle 224 is opened, and hence the wash water is sprayed toward the door 10. Meanwhile, pressure control can be easily achieved by adjusting the output of a circulator pump (not shown) for controlling the pressure at which the suction unit 32 sucks the wash water. The circulator pump (not shown) is generally supplied with a driving force from a driving source, and accordingly the control of the output thereof can be easily achieved by controlling the number of rotations of the driving source 15.

Additionally, the nozzles 200 are provided with a steam nozzle valve 216 which can select any one of a door unit steam nozzle 212 and a drum steam nozzle 214. The steam nozzle valve 216 also may consists of a ball 216*a* and a spring 216*b*, and the opening or not of the door unit steam nozzle 212 is determined in the same manner as in the circulator nozzle valve 226. A pressure control of introduced steam can be easily achieved by adjusting the amount of steam generated by the steam generator 50.

Hereinafter, a washing method of a drum washing machine in accordance with the present invention will be described in association with how the procedure of washing the door unit in the drum washing machine will be carried out.

For the drum washing machine to carry out a washing stroke, when the water supply valve 52 (see FIG. 2) is opened, a water supply step S110 is carried out to introduce wash water into the tub 30 via the detergent supplier 60. After the water supply step S110 is carried out, a tub heating step S120 may be carried out to heat the wash water in the tub 30. Though the same tub heating step S120 is not an essential part of the present invention, it is preferable to carry out the same step S120 because the washing of laundry using heated wash water can increase washing efficiency.

After the tub heating step S120, a door unit steam spraying step S130 may be carried out to spray heated steam to the door unit 8A. The same step S130 is not essential, too. As steam is sprayed to the door 10 in the same step S130, dirt stuck on the door 10 is swollen by steam and thus becomes easily removable. It is not always necessary to carry out the door unit steam spraying step S130 after the tub heating step S120, and the door unit steam spraying step S130 is not necessarily essential.

Thereafter, a door unit circulation water spraying step S140 is carried out to suck the wash water stored in the tub 30 via the suction unit 32 and spray the wash water to the door 10. In the same step S140, dirt stuck on the door 10 is removed by the pressure of the wash water.

Hereinafter, the washing stroke is finished after other steps S150, which are various steps related to the original washing stroke, are carried out.

Although the present invention has been described in connection with the embodiment illustrated in the drawings, the embodiments are merely for illustrative purposes. It will be understood by those skilled in the art that various modifications and other equivalent embodiments can be made thereto. Therefore, the true technical scope of the invention should be construed as being defined by the appended claims.

What is claimed is:

1. A drum washing machine, comprising:

a cabinet having a door;

a tub configured to store wash water and disposed inside the cabinet;

a drum rotatably disposed inside the tub; and a circulator capable of spraying wash water into the drum and toward the door, the circulator comprising a suction unit to extract wash water stored in the tub, wherein the circulator comprises a door circulator nozzle for spraying wash water toward the door and a drum circulator nozzle for spraying wash water into the drum, wherein the suction unit supplies wash water to a wash water conduit that supplies wash water to both the door circulator nozzle and the drum circulator nozzle, wherein the circulator further comprises a circulator nozzle valve, wherein the circulator nozzle valve allows wash water to be sprayed from at least one of the door circulation nozzle and the drum circulation nozzle depending on a pressure of the wash water sucked by the suction unit, and wherein the circulator nozzle valve is configured to have movement of the circulator nozzle valve automatically controlled by water pressure from the wash water conduit such that when the pressure of wash water supplied from the suction unit into the water conduit is higher than a pressure of a predetermined level, the circulator nozzle valve opens the door circulator nozzle.

2. The drum washing machine of claim 1, wherein the cross sectional area of the door circulator nozzle is smaller than the cross sectional area of the drum circulator nozzle.

3. The drum washing machine of claim 1, wherein the door circulator nozzle is configured such that the velocity of the wash water discharged from the door circulator nozzle exceeds the velocity of the wash water discharged from the drum circulator nozzle.

4. The drum washing machine of claim 1, further comprising a steam generator that is used to spray heated steam towards at least one of the drum and the door.

5. The drum washing machine of claim 4, wherein the circulator further comprises a door steam nozzle facing the door and a drum steam nozzle facing into the drum.

6. The drum washing machine of claim 5, wherein the circulator further comprises a steam nozzle valve that allows steam to be sprayed from at least one of the door steam nozzle and the drum steam nozzle depending on a pressure of the steam generated by the steam generator.

7. The drum washing machine of claim 5, wherein the cross sectional area of the door steam nozzle is smaller than the cross sectional area of the drum steam nozzle.

* * * * *